US012102281B2

(12) United States Patent
Lee et al.

(10) Patent No.: US 12,102,281 B2
(45) Date of Patent: Oct. 1, 2024

(54) RAIL DEVICE FOR DISHWASHER

(71) Applicant: SEGOS CO., LTD., Incheon (KR)

(72) Inventors: Doo Myun Lee, Incheon (KR); Sai Ryun Kim, Incheon (KR)

(73) Assignee: SEGOS CO., LTD., Incheon (KR)

( * ) Notice: Subject to any disclaimer, the term of this patent is extended or adjusted under 35 U.S.C. 154(b) by 268 days.

(21) Appl. No.: 17/760,857

(22) PCT Filed: Sep. 10, 2020

(86) PCT No.: PCT/KR2020/012211
§ 371 (c)(1),
(2) Date: Mar. 16, 2022

(87) PCT Pub. No.: WO2021/054673
PCT Pub. Date: Mar. 25, 2021

(65) Prior Publication Data

US 2022/0287544 A1 Sep. 15, 2022

(30) Foreign Application Priority Data

Sep. 18, 2019 (KR) ..... 10-2019-0115033

(51) Int. Cl.
*A47L 15/50* (2006.01)

(52) U.S. Cl.
CPC ..... *A47L 15/507* (2013.01)

(58) Field of Classification Search
CPC ..... A47L 15/507
See application file for complete search history.

(56) References Cited

U.S. PATENT DOCUMENTS 3,469,892 A * 9/1969 Langstroth ..... F16C 13/006 16/98
2012/0074822 A1* 3/2012 Oppel ..... A47L 15/507 312/228
2012/0139399 A1 6/2012 McDaniel
(Continued)

FOREIGN PATENT DOCUMENTS

DE 299 02 915 U1 7/2000
EP 1195129 A1 4/2002
(Continued)

OTHER PUBLICATIONS

Extended European Search Report dated Sep. 28, 2023 in European Application No. 20865268.5.
(Continued)

*Primary Examiner* — Matthew W Ing
(74) *Attorney, Agent, or Firm* — Sughrue Mion, PLLC

(57) ABSTRACT

Provided is a rail device for a dishwasher including a guide main body part; an upper support roller part coupled to one side of the guide main body part to be rotatable with respect to a central axis; a lower support roller part coupled to one side of the guide main body part to be rotatable with respect to a central axis; a guide rail part extendedly formed along the sliding direction with one side inserted into the space between the upper support roller part and the lower support roller part; and a rack roller part having one side inserted into the guide rail part and the other side coupled to one surface inside the main body of the dishwasher or coupled to the sliding basket.

18 Claims, 13 Drawing Sheets

(56) References Cited

U.S. PATENT DOCUMENTS

| | | | |
|---|---|---|---|
| 2014/0145573 | A1 | 5/2014 | Cox et al. |
| 2016/0360946 | A1 | 12/2016 | Shewmaker |
| 2018/0140166 | A1 | 5/2018 | Meier et al. |

FOREIGN PATENT DOCUMENTS

| | | | |
|---|---|---|---|
| JP | 09-010165 | A | 1/1997 |
| KR | 10-1158584 | B1 | 6/2012 |
| WO | 2019/117480 | A1 | 6/2019 |

OTHER PUBLICATIONS

International Search Report for PCT/KR2020/012211 dated Jan. 5, 2021.
Written Opinion for PCT/KR2020/012211 dated Jan. 5, 2021.

* cited by examiner

[Fig.1]
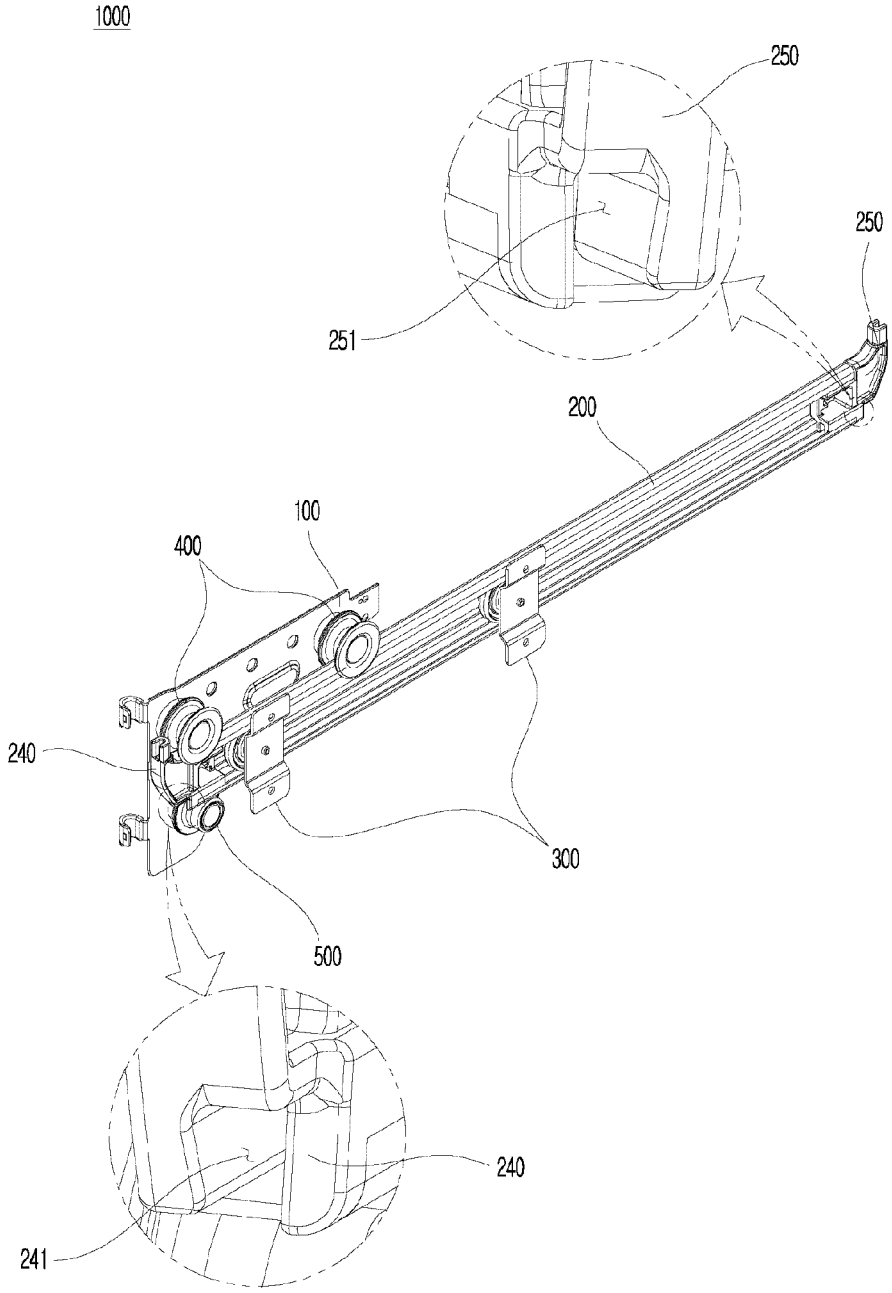

[Fig.2]
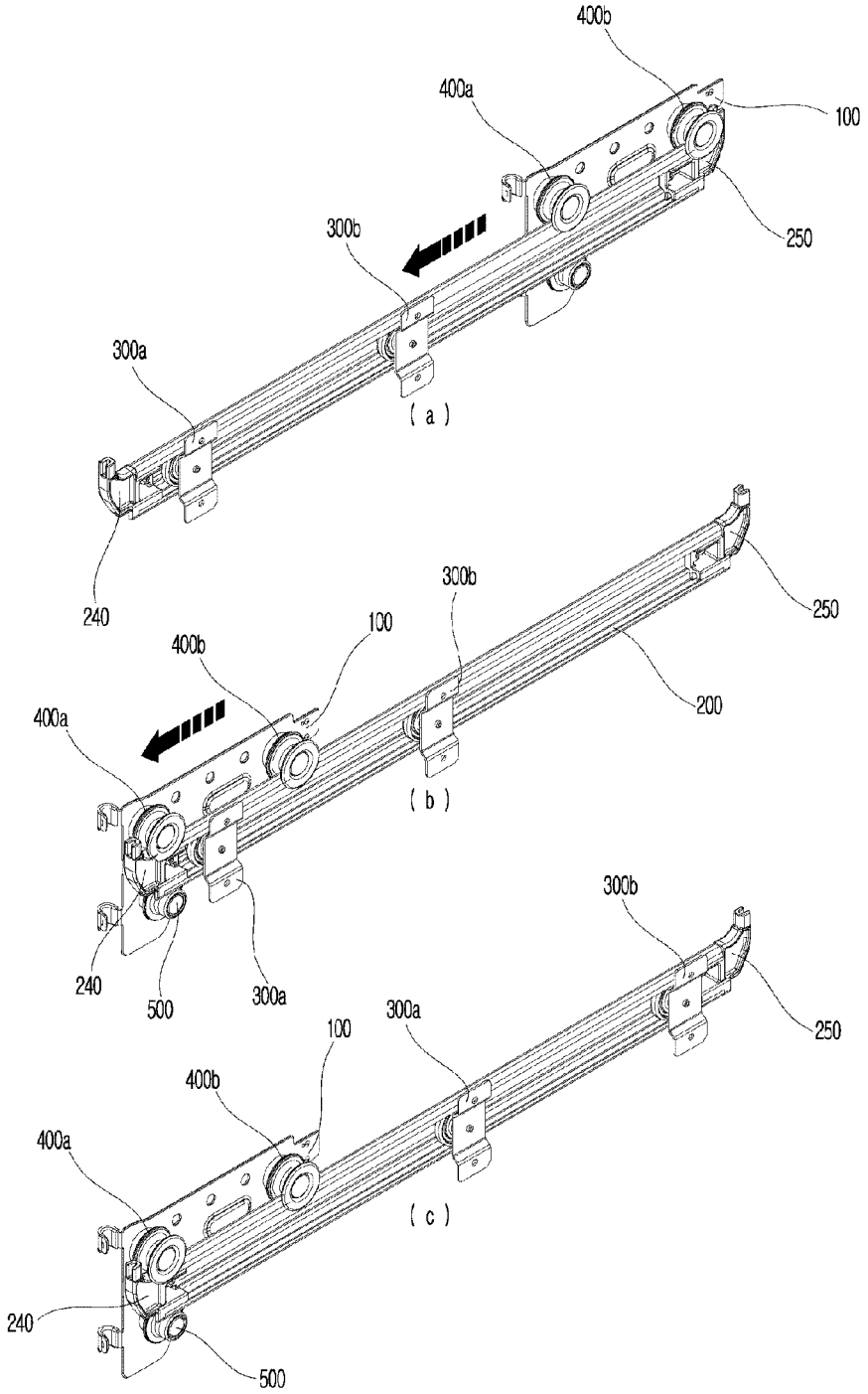

[Fig.3]
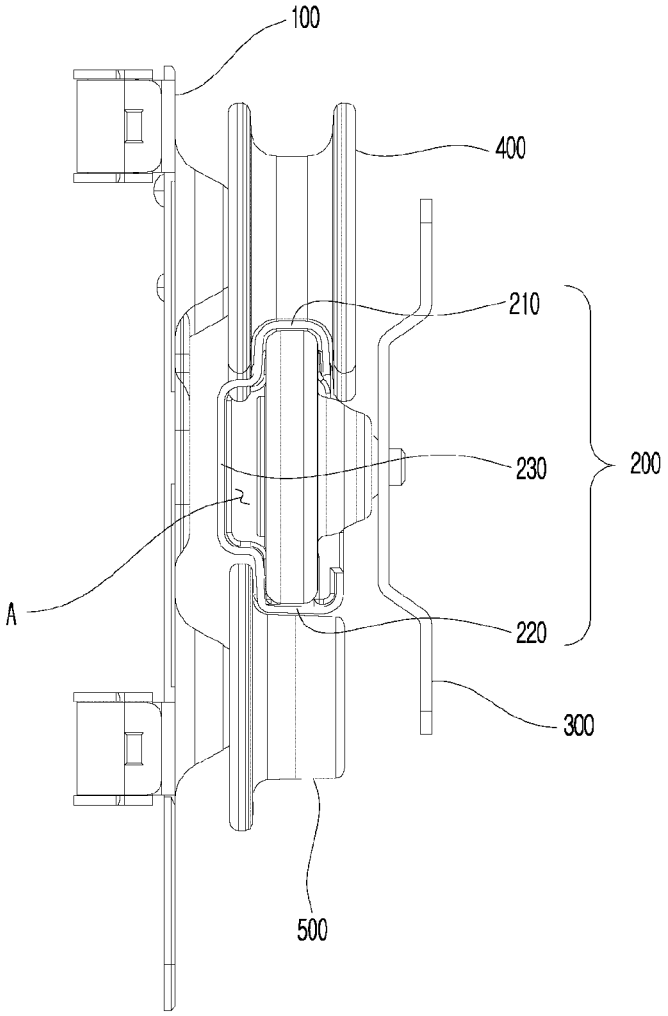

[Fig.4]
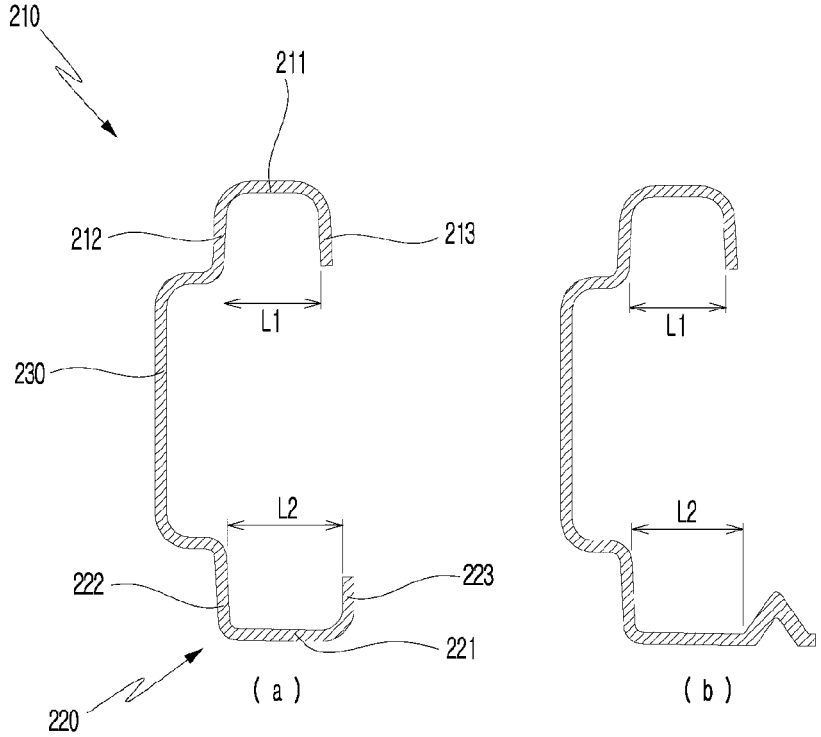

[Fig.5]
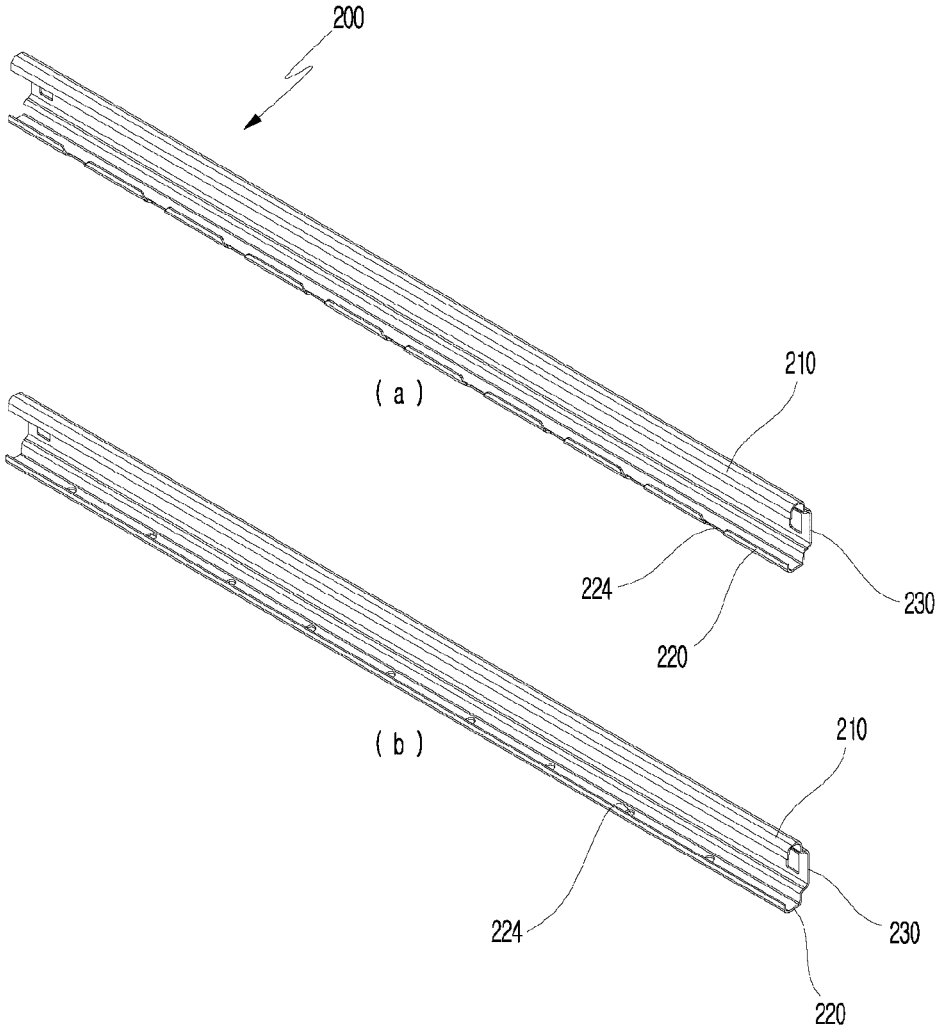

[Fig.6]
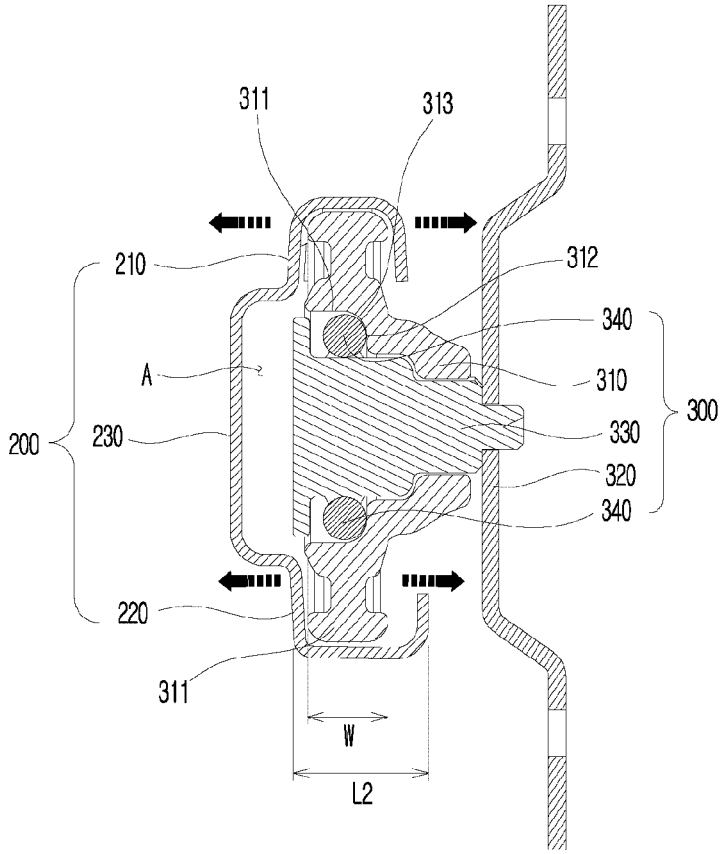

[Fig.7]
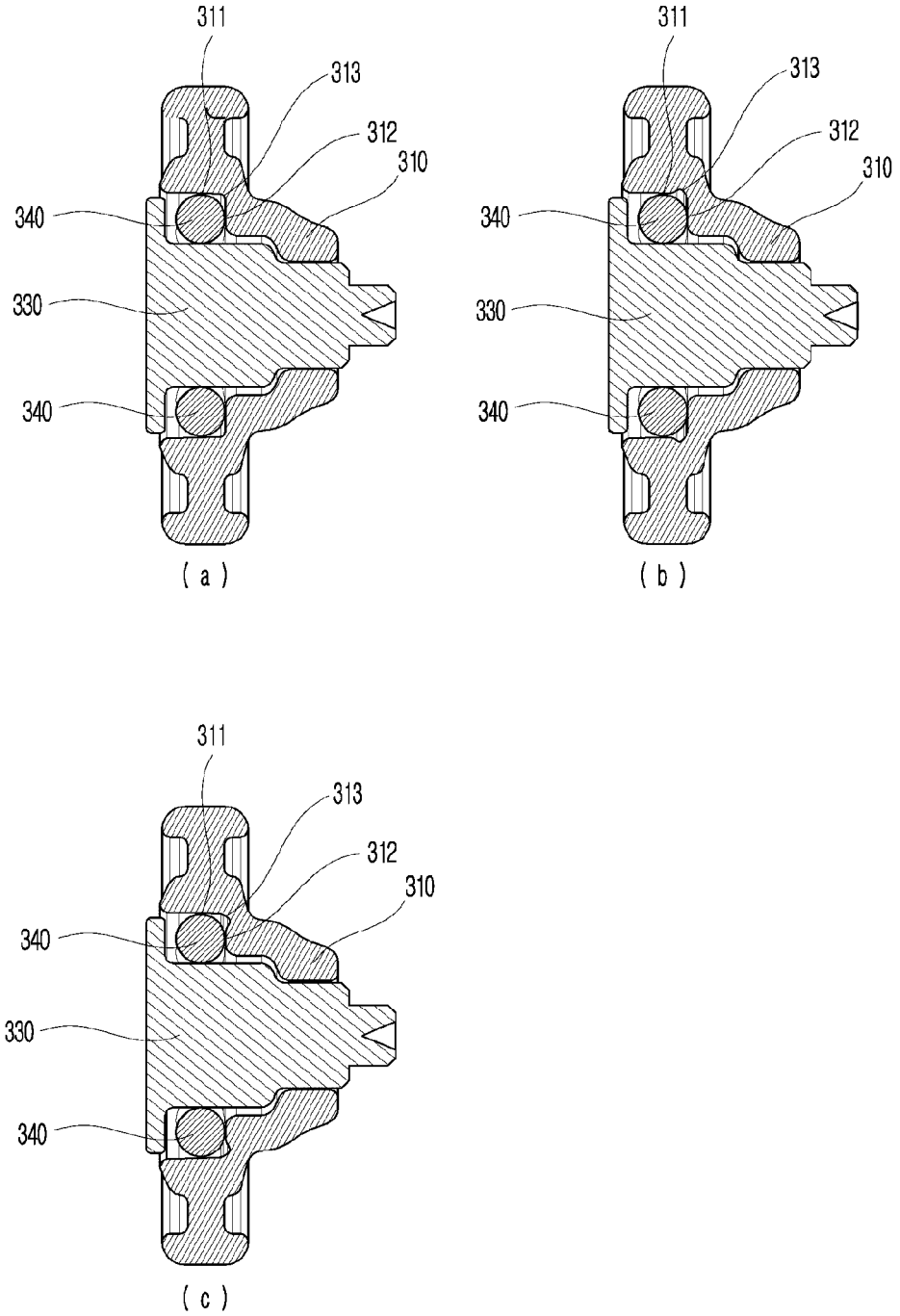

[Fig.8]
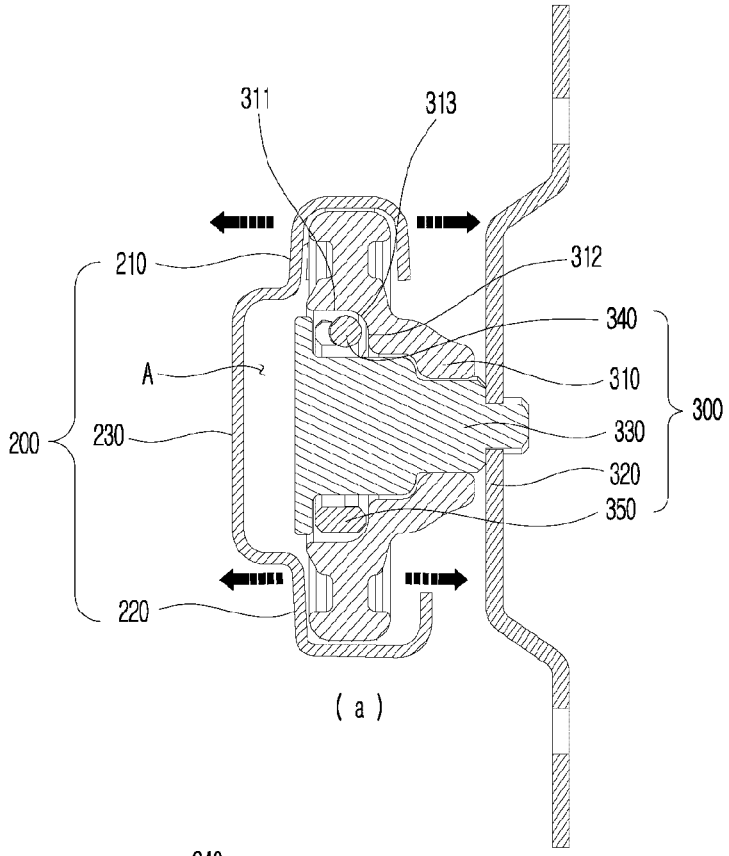
( a )
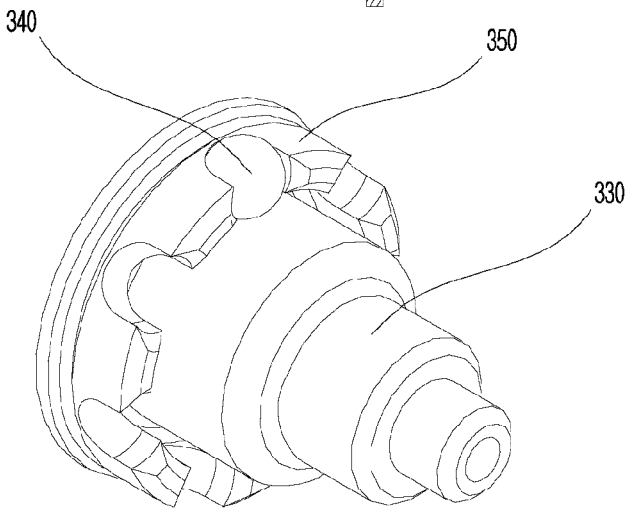
( b )

[Fig.9]
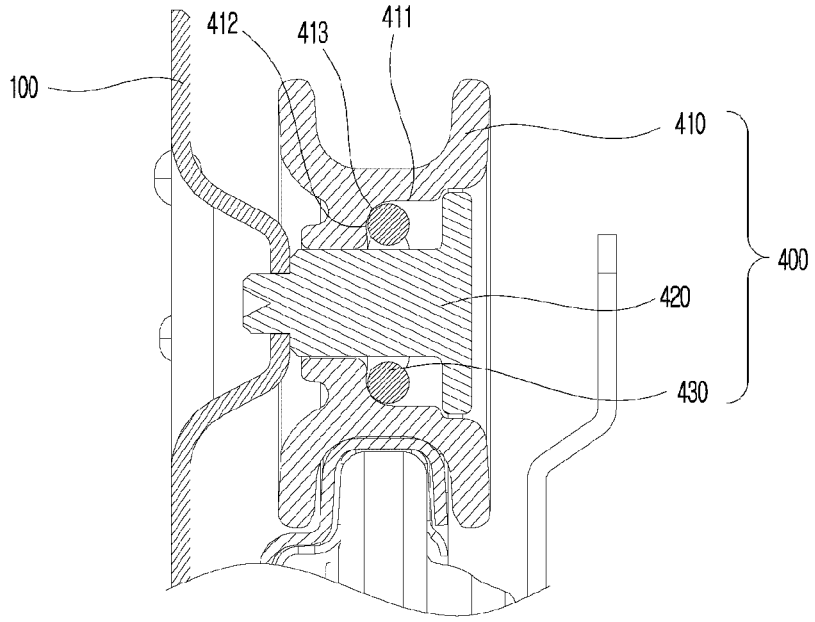

[Fig.10]
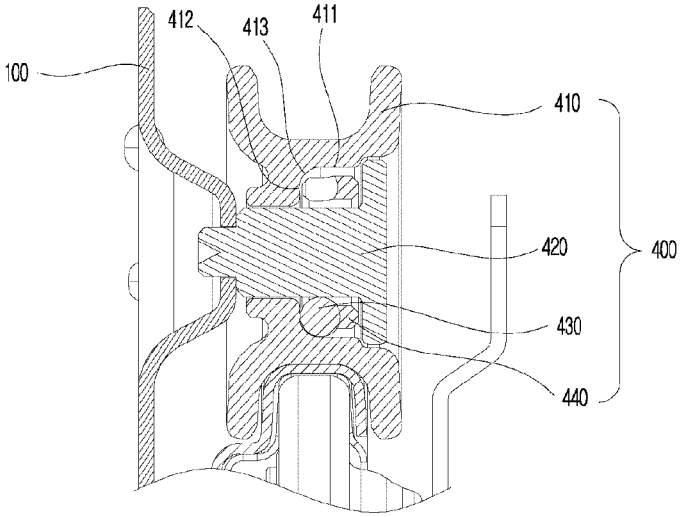
( a )
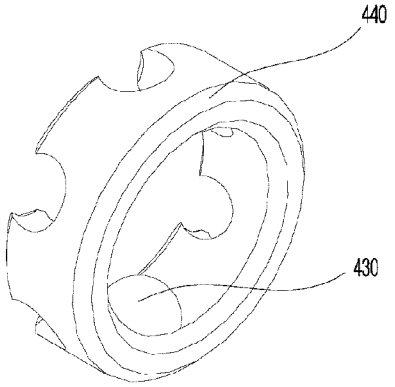
( b )

[Fig.11]
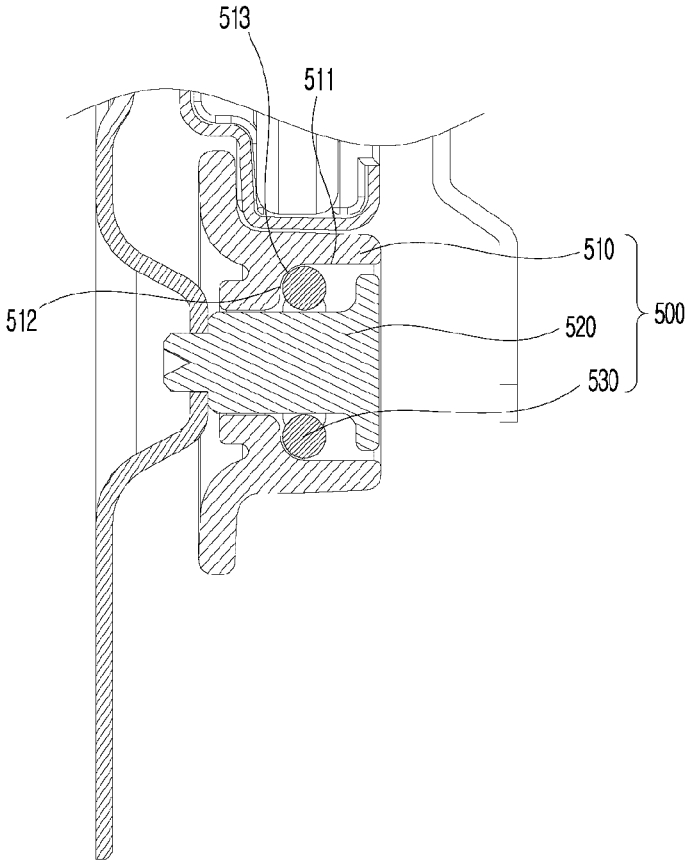

[Fig.12]
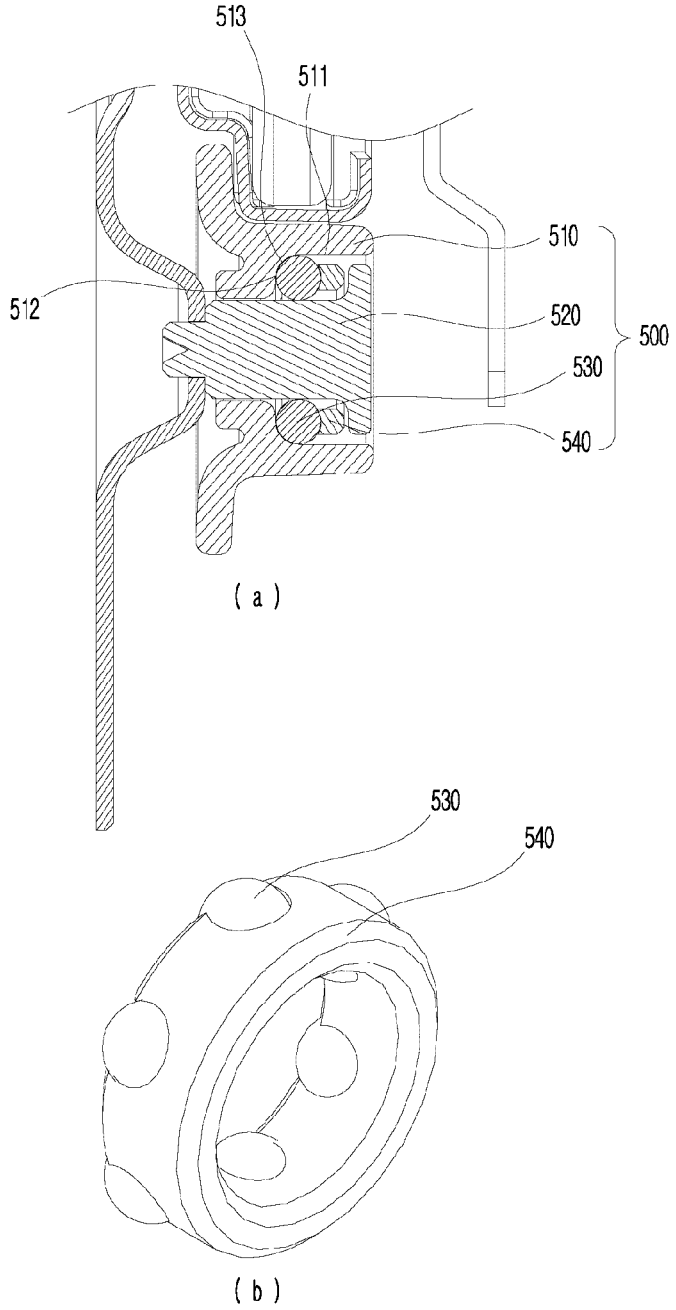

[Fig.13]
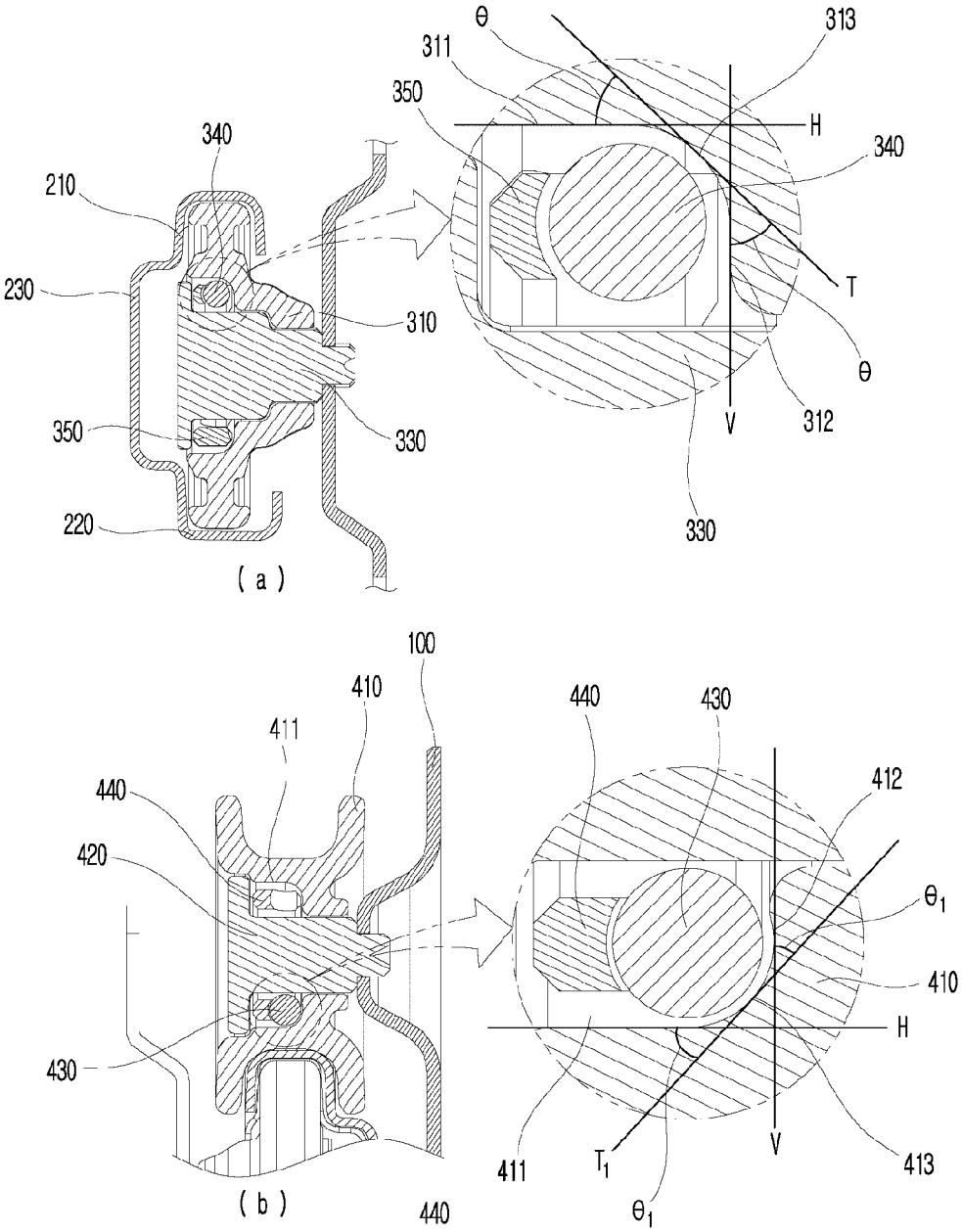

RAIL DEVICE FOR DISHWASHER

CROSS REFERENCE TO RELATED APPLICATIONS

This application is a National Stage of International Application No. PCT/KR2020/012211 filed Sep. 10, 2020, claiming priority based on Korean Patent Application No. 10-2019-0115033 filed Sep. 18, 2019, the entire disclosures of which are incorporated herein by reference.

TECHNICAL FIELD

The present invention relates to a rail device for a dishwasher. More specifically, the present invention relates to a rail device for a dishwasher provided with a guide rail having a structure wherein the width of the lower guide part is configured to be greater than or equal to the width of the upper guide part, so that the operability may be improved by absorbing the change in horizontal movement of the sliding basket more easily.

BACKGROUND ART

A dishwasher is a kitchen appliance that can automatically wash and dry dishes, cups, and cutlery. The dishwasher works by washing dishes using a strong water stream after soaking food in hot steam and detergent, and the performance is generally evaluated based on how perfectly a high-pressure water stream is sprayed without a missing part to wash out the food.

The dishwasher as described above is a home appliance which helps making our life more convenient and reduces housework hours like the existing air purifiers, dryers and steam closets. Recently, the sales of dishwashers are increasing around the globe including Korea.

Dishes, cutlery, etc. to be washed in the dishwasher may be put in through a sliding basket which slides in and out of the dishwasher, and the above sliding basket generally slides in the entry/exit direction by the guide of the rail device for dishwasher fixedly coupled to an inner wall of the dishwasher.

However, when the conventional rail device is applied to a dishwasher, a water stream of high pressure is applied at various angles inside the dishwasher, thereby causing horizontal movement and impact to the sliding basket in the left and right sides of the guide rail. Accordingly, the rail device applied to the dishwasher needs to have a function securing the amount of clearance between the left and right sides or absorbing the horizontal movement in correspondence thereto.

PRIOR ART LITERATURE

Korean Patent No. 10-1158584 (Jun. 14, 2012)

DETAILED DESCRIPTION OF INVENTION

Technical Task

The present invention aims at solving the problems of prior art as described above, and it is an object of the present invention to provide a rail device for a dishwasher provided with a guide rail having a structure wherein the width of the lower guide part is configured to be greater than or equal to the width of the upper guide part, so that the operability may be improved by absorbing the change in horizontal movement of the sliding basket more easily.

Means for Solving Technical Task

In order to achieve the above object, an aspect of the present invention may be a rail device for a dishwasher, comprising: a guide main body part; an upper support roller part coupled to one side of the guide main body part to be rotatable with respect to a central axis; a lower support roller part coupled to one side of the guide main body part to be rotatable with respect to a central axis; a guide rail part extendedly formed along the sliding direction with one side inserted into the space between the upper support roller part and the lower support roller part; and a rack roller part having one side inserted into the guide rail part and the other side coupled to one surface inside the main body of the dishwasher or coupled to the sliding basket, wherein the guide rail part comprises an upper guide part having a shape corresponding to the circumference of the upper support roller part and a lower guide part having a shape corresponding to the circumference of the lower support roller part, and the width L2 of the lower guide part is formed to be greater than or equal to the width L1 of the upper guide part.

According to an embodiment of the present invention, the width ratio (D=width L1 of the upper guide part/width L2 of the lower guide part) of the upper guide part and the lower guide part may be greater than or equal to 0.45 and less than or equal to 1.0.

According to an embodiment of the present invention, the guide rail part may further comprise a middle guide part connecting the upper guide part and the lower guide part, and the middle guide part may be formed to be spaced apart from the rack roller part inserted into the guide rail part by a predetermined interval so as to form a hollow space A between the guide rail part and the rack roller part.

According to an embodiment of the present invention, the upper guide part may comprise an upper part, a first upper side surface part bent from one end of the upper part and a second upper side surface part bent from the other end of the upper part, and the lower part of the first upper side surface part may be connected to an upper part of the middle guide part.

According to an embodiment of the present invention, the lower guide part may comprise a lower part, a first lower side surface part bent from one end of the lower part and a second lower side surface part bent from the other end of the lower part, and the upper part of the first lower side surface part may be connected to a lower part of the middle guide part.

According to an embodiment of the present invention, the rack roller part may comprise a rack roller main body part inserted into the guide rail part to be rotatable with respect to the central axis; a rack member part fixedly coupled to one surface inside the main body of the dishwasher; and a rack coupling part penetratingly coupling the center of the rack roller main body part to one side of the rack member part, and the rack coupling part may couple the rack roller main body part and the rack member part to be spaced apart so that the rack roller part moves horizontally by a predetermined distance.

According to an embodiment of the present invention, the rack roller part may further comprise a rack bearing part provided with one or more bearings disposed in a space between the inner circumference surface of the rack roller main body part and the outer circumference surface of the rack coupling part.

According to an embodiment of the present invention, the rack bearing part may be spaced apart from the inner circumference surface of the rack roller main body part so that the rack roller part moves horizontally by a predetermined distance.

According to an embodiment of the present invention, the inner circumference surface of the rack roller main body part may comprise a horizontal surface part, a vertical surface part and a connecting part connecting the horizontal surface part and the vertical surface part.

According to an embodiment of the present invention, the upper support roller part may comprise a first roller frame part rotatable with respect to the central axis, whose circumference surface is formed to correspond to the upper guide part; and a first roller coupling part penetratingly coupling the center of the first roller frame part to one side of the guide main body part, and the first roller coupling part may couple the first roller frame part and the guide main body part to be spaced apart so that the upper support roller part moves horizontally by a predetermined distance.

According to an embodiment of the present invention, the upper support roller part may further comprise a first bearing part provided with one or more bearings disposed in a space between the inner circumference surface of the first roller frame part and the outer circumference surface of the first roller coupling part.

According to an embodiment of the present invention, the first bearing part may be spaced apart from the inner circumference surface of the first roller frame part so that the upper support roller part moves horizontally by a predetermined distance.

According to an embodiment of the present invention, the lower support roller part may comprise a second roller frame part rotatable with respect to the central axis, whose circumference surface is formed to correspond to the lower guide part; and a second roller coupling part penetratingly coupling the center of the second roller frame part to one side of the guide main body part, and the second roller coupling part may couple the second roller frame part and the guide main body part to be spaced apart so that the lower support roller part moves horizontally by a predetermined distance.

According to an embodiment of the present invention, the lower support roller part may further comprise a second bearing part provided with one or more bearings disposed in a space between the inner circumference surface of the second roller frame part and the outer circumference surface of the second roller coupling part.

According to an embodiment of the present invention, the second bearing part may be spaced apart from the inner circumference surface of the second roller frame part so that the lower support roller part moves horizontally by a predetermined distance.

According to an embodiment of the present invention, the width L2 of the lower guide part may be formed to be larger than the width W of the rolling part of the rack roller main body part.

Effect of Invention

According to an aspect of the present invention, the width of the lower guide part may be formed to be greater than or equal to the width of the upper guide part, so that the operability of the rail device for dishwasher may be improved by absorbing the horizontal movement and impact of the guide rail more easily.

Also, jamming during operation may be prevented by removing a bearing track part from the inner circumference surface of the rack roller main body part, and the manufacturing cost may be saved by removing a separate process for forming a bearing track part.

The effects of the present invention are not limited to the above-mentioned effects, and it should be understood that the effects of the present invention include all effects that could be inferred from the configuration of the invention described in the detailed description of the invention or the appended claims.

BRIEF DESCRIPTION OF DRAWINGS

FIG. 1 is a perspective view and a partially enlarged view of a rail device for a dishwasher according to an embodiment of the present invention;

FIG. 2 is a flowchart illustrating the sliding in the drawing-out direction of a rail device for a dishwasher according to the present invention;

FIG. 3 is a side view of a rail device for a dishwasher according to the present invention;

FIG. 4 is a side view of a guide rail part according to an embodiment of the present invention;

FIG. 5 is a perspective view of a guide rail part according to an embodiment of the present invention;

FIG. 6 is a cross-sectional view of a rack roller part according to an embodiment of the present invention;

FIG. 7 is a cross-sectional view illustrating various forms of the configuration of a connecting part of the rack roller main body part according to an embodiment of the present invention;

FIG. 8 shows a cross-sectional view of a rack roller part and a perspective view of a rack coupling part according to another embodiment of the present invention, respectively;

FIG. 9 is a cross-sectional view of an upper support roller part according to an embodiment of the present invention;

FIG. 10 shows a cross-sectional view of an upper support roller part and a perspective view of a first bearing seating part according to another embodiment of the present invention, respectively;

FIG. 11 is a cross-sectional view of a lower support roller part according to an embodiment of the present invention;

FIG. 12 shows a cross-sectional view of a lower support roller part and a perspective view of a second bearing seating part according to another embodiment of the present invention, respectively; and FIG. 13 shows a partial enlarged view of a rack roller part and a partial enlarged view of an upper support roller part, respectively.

DETAILED MEANS FOR CARRYING OUT THE INVENTION

Hereinafter, the present invention will be explained with reference to the accompanying drawings. The present invention, however, may be modified in various different ways, and should not be construed as limited to the embodiments set forth herein. Also, in order to clearly explain the present invention in the drawings, portions that are not related to the present invention are omitted, and like reference numerals are used to refer to like elements throughout the specification.

Throughout the specification, it will be understood that when a portion is referred to as being "connected" to another portion, it can be "directly connected to" the other portion, or "indirectly connected to" the other portion having intervening portions present. Also, when a component "includes" an element, unless there is another opposite description thereto, it should be understood that the component does not exclude another element but may further include another element.

Hereinafter, the embodiments of the present invention will be described in detail with reference to the accompanying drawings.

FIG. 1 is a perspective view and a partially enlarged view of a rail device for a dishwasher according to an embodiment of the present invention. FIG. 2 is a flowchart illustrating the sliding in the drawing-out direction of a rail device for a dishwasher according to the present invention. FIG. 3 is a side view of a rail device for a dishwasher according to the present invention.

As illustrated in FIGS. 1 to 3, the rail device 1000 for dishwasher according to the present invention comprises a guide main body part 100, an upper support roller part 400, a lower support roller part 500, a rack roller part 300, and a guide rail part 200.

The rail device 1000 for dishwasher according to the present invention may be implemented in the form of a first embodiment wherein the guide main body part 100 is coupled to the sliding basket to slide integrally therewith and the rack roller part 300 is coupled to one surface inside the dishwasher, or in the form of a second embodiment wherein the guide main body part 100 is coupled to one surface inside the dishwasher and the rack roller part 300 is coupled to the sliding basket to slide integrally therewith.

Hereinafter, for the sake of convenience in explanation, the present invention will be explained focusing on the first embodiment. However, it is obvious that various embodiments described in the following may be applied similarly to the second embodiment of the present invention.

The guide main body part 100 is a member coupled to one side of the sliding basket which moves in and out of the dishwasher to move integrally with the sliding basket.

The guide main body part 100 has a relatively narrow width, and may have two surfaces having a predetermined cross-sectional area wherein one side surface is coupled to one side of the sliding basket and the other side is coupled to the upper support roller part 400 and the lower support roller part 500.

The upper support roller part 400 and the lower support roller part 500 are respectively coupled to positions spaced apart from each other on one surface of the guide main body part 100, and may be formed in a rotatable cylindrical shape with respect to an axis perpendicular to one surface of the guide main body part 100 as the central axis.

The guide main body part 100 and the sliding basket are supported by a load by the guide rail part 200 inserted into the space between the upper support roller part 400 and the lower support roller part 500 while guiding sliding at the same time.

As illustrated, the upper support roller part 400 may be formed with a concave part having a predetermined depth along the circumference direction of the central axis. The concave part is formed to correspond to the upper guide part 210 of the guide rail part 200 which will be described in the following.

At this time, the concave part of the upper support roller part 400 according to an embodiment of the present invention may be formed to have a cross section gradually narrowing along the depth direction while being symmetrical with respect to the center along the circumference direction. In this case, since the concave part encloses the outer circumference surface of the upper guide part 210, the load can be stably supported while the upper support roller part 400 is fastened to the guide rail part 200.

On the other hand, a plurality of upper support roller parts 400 may be formed on one surface of the guide main body part 100. In this case, the load of the sliding basket and the guide main body part 100 may be supported in a dispersed state according to the number and position of the plurality of upper support roller parts 400.

Similarly, the lower support roller part 500 may be formed with a concave part having a predetermined depth along the circumference direction of the central axis. The concave part is formed to correspond to the lower guide part 220 of the guide rail part 200 which will be described in the following.

At this time, the concave part of the lower support roller part 500 according to an embodiment of the present invention may be formed to have a cross section gradually narrowing along the depth direction while being symmetrical with respect to the center along the circumference direction. In this case, since the concave part encloses the outer circumference surface of the lower guide part 220, the load can be stably supported while the lower support roller part 500 is fastened to the guide rail part 200.

On the other hand, the width of the concave part of the lower support roller part 500 may be formed to be larger than the width of the concave part of the upper support roller part 400. This is to correspond to forming the width of the lower guide part 220 to be larger than the width of the upper guide part 210, which will be described in the following. Details thereof will be described later.

According to an embodiment, the lower support roller part 500 may be formed in an open-type structure wherein the outside is opened along the axial direction. More specifically, the lower support roller part 500 may have a predetermined depth along the circumference direction of the central axis, and may be formed with a concave part having a form whose outside is open along the axial direction. This is also to correspond to forming the width of the lower guide part 220 to be larger than the width of the upper guide part 210, which will be described in the following. Details thereof will be described later.

One side of the rack roller part 300 is inserted into the guide rail part 200, and the other side is fixedly coupled to one surface of the inner wall of the main body of the dishwasher.

In other words, one side of the rack roller part 300 is inserted into the rail of the guide rail part 200 to serve the role of guiding or stopping the sliding in the entry/exit direction of the sliding basket which moves integrally with the guide rail part 200.

The other side of the rack roller part 300 is fixedly coupled to one surface of the inner wall of the dishwasher, and serves the role of supporting the load from the sliding basket. In particular, in order to stably support the sliding basket, a plurality of rack roller parts 300 may be formed. In other words, a plurality of rack roller parts 300 may be formed being spaced apart from each other at a predetermined interval, and at this time, the angle formed between each rack roller part 300 determines the entry/exit direction of the sliding basket.

FIG. 4 is a side view of a guide rail part according to an embodiment of the present invention. FIG. 5 is a perspective view of a guide rail part according to an embodiment of the present invention.

With reference to FIGS. 1 to 5, one side of the guide rail part 200 is inserted into the space between the upper support roller part 400 and the lower support roller part 500. At this time, the guide rail part 200 receives the load of the sliding basket by the upper support roller part 400, and is supported by the rack roller part 300 inserted into the rail of the guide rail part 200.

When the guide rail part 200 is constrained by the guide main body part 100, the guide rail part 200 may move integrally, and needs to be formed in a length that can open and close the sliding basket sufficiently.

More specifically, the guide rail part 200 may be formed to comprise an upper guide part 210, a lower guide part 220, a front locking part 240 and a rear locking part 250.

The front locking part 240 and the rear locking part 250 are respectively formed at both the front and rear ends of the guide rail part 200. The front locking part 240 and the rear locking part 250 serve the role of constraining the guide rail part 200 to the guide main body part 100, while colliding into the rack roller part 300 inserted into the rail to serve the role of a stopper stopping the sliding of the guide rail part 200.

At this time, the front locking part 240 and the rear locking part 250 comprise a shape locked to the upper support roller part 400 or the lower support roller part 500.

As illustrated in the drawings, the front locking part 240 and the rear locking part 250 according to an embodiment of the present invention may comprise a protruding ring part to enclose the cylindrical shape of the upper support roller part 400. In addition, the front locking part 240 and the rear locking part 250 may have various shapes locked to the upper support roller part 400 or the lower support roller part 500.

According to an embodiment, a front drainage structure 241 and a rear drainage structure 251 for smooth drainage and discharge of foreign substances may be formed at the lower ends of the front locking part 240 and the rear locking part 250, respectively. At this time, the drainage structures 241, 251 may be formed by cutting the front locking part 240 and the rear locking part 250 in a predetermined size at the lower end of the vertical surface.

In addition, it is preferable to form the front drainage structure 241 and the rear drainage structure 251 to be cut to the bottom surfaces of the front locking part 240 and the rear locking part 250.

Accordingly, even in a state wherein the front and rear of the guide rail part 200 are closed by the front locking part 240 and the rear locking part 250, the washing water and foreign substances accumulated in the lower guide part 220 may be easily removed from the front drainage structure 241 and the rear drainage structure 251.

Meanwhile, as illustrated in FIGS. 4 and 5, the guide rail part 200 may be formed in a structure having a "C" shape cross-section.

The upper guide part 210 is formed to correspond to the shape of the circumference surface of the upper support roller part 400, and is configured to slide in a state corresponding to the concave part formed along the circumference of the upper support roller part 400.

More specifically, the upper guide part 210 may be configured to have an upper part 211, a first upper side surface part 212 and a second upper side surface part 213. The lower part of the first upper side surface part 212 is configured to be connected to an upper part of the middle guide part 230 which will be described in the following.

The lower guide part 220 is formed to be seated on the circumference surface of the lower support roller part 500, and is configured to slide in a state seated in the concave part formed along the circumference of the lower support roller part 500.

More specifically, the lower guide part 220 may be configured to have a lower part 221, a first lower side surface part 222 and a second lower side surface part 223. The upper part of the first lower side surface part 222 is configured to be connected to a lower part of the middle guide part 230 which will be described in the following.

According to an embodiment, the width L2 of the lower guide part 220 is formed to be greater than or equal to the width L1 of the upper guide part 210.

Conventionally, the upper guide part 210 and the lower guide part 220 were formed to have the same width, and thus there was a problem that horizontal movement was not smooth during the operation with the rack roller part 300, thereby deteriorating sliding operability.

Accordingly, the width L2 of the lower guide part 220 according to the present invention is formed to be greater than or equal to the width L1 of the upper guide part 210, thereby improving the operability of the rail device 1000 for dishwasher by absorbing the horizontal movement and impact of the guide rail part 200 more smoothly.

At this time, according to an embodiment, the width ratio (D=width L1 of the upper guide part/width L2 of the lower guide part) of the upper guide part and the lower guide part is greater than or equal to 0.45 and less than or equal to 1.0.

When the width ratio D of the upper guide part and the lower guide part is less than 0.45, excessive movement is made in the mutual width direction of the rack roller part 300 and the guide rail part 200 during the sliding process, thereby causing the roller to be separated.

The guide rail part 200 according to an embodiment of the present invention may further comprise a middle guide part 230 connecting the upper guide part 210 and the lower guide part 220. The middle guide part 230 may be formed to be spaced apart from the rack roller part 300 inserted into the guide rail part 200 by a predetermined interval so as to form a hollow space A between the guide rail part 200 and the rack roller part 300.

Hereinafter, a detailed operation method and function of the rail device 1000 for dishwasher according to an embodiment of the present invention with the above structure will be described in detail with reference to FIG. 2.

In a state wherein a sliding basket is inserted into the dishwasher, one side 300*a* of the rack roller part is positioned to be in contact with the front locking part 240, and one side 400*b* of the upper support roller part is positioned to be in contact with the locking part of the rear locking part 250. Then, the sliding basket is slid in the drawing-out direction by the user's operation.

Thereafter, the guide main body part 100 integrally coupled to the sliding basket moves in the drawing-out direction together, and slides from the rear locking part 250 side to the front locking part 240 side by the guidance of the guide rail part 200. Then, the other side 400*a* of the upper support roller comes into contact with the locking part of the front locking part 240, so that the guide main body part 100 is constrained by the guide rail part 200.

Thereafter, the guide rail part 200 moves in the drawing-out direction integrally with the sliding basket by the guide main body part 100, and the other side 300*b* of the rack roller part inserted into the rail of the guide rail part 200 gets closer to the rear locking part 250 side. Then, the other side 300*b* of the rack roller collides with the rear locking part 250, thereby stopping the sliding of the sliding basket and preventing the sliding basket from being separated from the dishwasher.

However, the sliding order of the guide main body part 100 and the guide rail part 200 in the process of drawing out the sliding basket is not limited to the above, and the sliding order may vary depending on the specific design of the dishwasher to which the present invention is applied, or the degree of pulling when the user draws out the sliding basket. For example, the guide main body part 100 and the guide rail part 200 may slide out at the same time starting from the first time being drawn out, or the guide main body part 100 may slide out later after the guide rail part 200 starts sliding.

Meanwhile, when the drainage function of the rail device 1000 for dishwasher is not performed smoothly during the process of drawing out the sliding basket as above, as described above, the dishwasher may open in a state wherein a large amount of water used for washing dishes in the dishwasher is not drained, thus causing the water to flow outside. In addition, foreign substances generated during the dish washing process may get caught in the rail device for dishwasher, thus frequently causing problems such as breakdown.

At this time, a plurality of drainage holes 224 may be formed in the lower guide part 220 according to an embodiment of the present invention. More specifically, a plurality of drainage holes 224 may be formed at a predetermined interval at the lower end 221 of the lower guide unit 220 or may be formed at a predetermined interval in the second lower side surface part 223 of the lower guide unit 220. Accordingly, together with the front drainage structure 241 and the rear drainage structure 251 described above, it becomes possible to smoothly discharge the water inside and outside the guide rail part 200, and immediately discharge water without having any foreign substances get caught in the dishwasher.

In addition, by having a hollow open space A formed between the middle guide rail part 230 and the rack roller part 300 according to an embodiment of the present invention, the dishwasher may be provided with a smoother drainage function and a foreign substance discharge function.

FIG. 6 is a cross-sectional view of a rack roller part according to an embodiment of the present invention. FIG. 7 is a cross-sectional view illustrating various forms of the configuration of a connecting part of the rack roller main body part according to an embodiment of the present invention. FIG. 8 shows a cross-sectional view of a rack roller part and a perspective view of a rack coupling part according to another embodiment of the present invention, respectively. FIG. 13 shows a partial enlarged view of a rack roller part and a partial enlarged view of an upper support roller part, respectively.

As illustrated in FIGS. 6 and 7, the rack roller unit 300 according to an embodiment of the present invention may comprise a rack roller main body part 310, a rack member part 320 and a rack coupling part 330.

The rack roller main body part 310 guides the sliding of the guide rail part 200 while being inserted into the guide rail part 200. The rack roller main body part 310 has a shape corresponding to the inner surfaces of the upper guide part 210 and the lower guide part 220, and the inside may be penetratingly formed so that the rack coupling part 330 is coupled along the central axis.

At this time, according to an embodiment, the width L2 of the lower guide part 220 is formed to be larger than the width W of the rolling part 311 of the rack roller main body part 310. Accordingly, horizontal movement may be absorbed more easily as the rolling part 311 of the rack roller main body part 310 is guided having a predetermined tolerance with the lower guide part 220.

The rack member part 320 has one side fixedly coupled to the inner wall of the main body of the dishwasher to support a load. More specifically, the rack member part 320 according to an embodiment of the present invention has a bent shape wherein a central part protrudes from an outer part by a predetermined height, and the rack coupling part 330 is penetratingly coupled to the central part. At this time, the outer part of the rack member part 320 may be coupled to the inner wall of the body of the dishwasher. However, the shape of the rack member part 320 is not limited to the above bent shape, and it is obvious that various other shapes may be applied.

A part of the rack coupling part 330 is formed inside the rack roller main body part 310 and penetrates the central axis of the rack roller main body part 310 and the central part of the rack member part 320, so as to couple the rack roller main body part 310 and the rack member part 320. At this time, the rack coupling part 330 is coupled having the rack roller main body part 310 spaced apart from the rack member part 320 so that the rack roller part 300 may be moved horizontally by a predetermined distance.

In other words, as illustrated in FIGS. 6 and 7, the rack roller part 300 may absorb the horizontal movement or impact from the sliding basket by spacing the rack coupling part 330 apart from the rack roller main body part 310 so as to form a predetermined width allowing the rack roller part 300 to move horizontally.

To this end, preferably, the rack coupling part 330 is formed so that the cross-sectional area of the part penetrating the rack roller main body part 310 is larger than the cross-sectional area of the part penetrating the rack member part 320.

The rack roller part 300 according to an embodiment of the present invention is characterized by further comprising a rack bearing part 340.

The rack bearing part 340 is a bearing seated on the rack bearing seating part 350, and one or more rack bearing parts 320 are disposed along the outer circumference surface of the rack coupling part 330 in a space between the inner circumference surface of the rack roller main body part 310 and the outer circumference surface of the rack coupling part 330. The rack bearing part 340 may absorb the horizontal movement or impact of the sliding basket in the bearing itself.

For the same purpose, the inner circumference surfaces of the rack bearing part 340 and the rack roller main body part 310 according to an embodiment of the present invention are spaced apart so that the rack roller part 300 may be moved horizontally by a predetermined distance.

Meanwhile, with reference to FIGS. 6, 7 and 13, when a bearing track part having a shape corresponding to the outer circumference surface of the rack bearing part 340 is formed on the inner circumference surface of the rack roller main body part 310, bearing jamming may occur during operation, thereby deteriorating operability. In addition, a separate process for forming a bearing track part is added to the process of manufacturing the rack roller main body part 310, thereby increasing the manufacturing cost.

Accordingly, the inner circumference surface of the rack roller main body part 310 according to an embodiment of the present invention is formed to comprise a horizontal surface part 331 and a vertical surface part 312. In other words, the jamming during operation may be prevented by removing the bearing track part from the inner circumference surface of the rack roller main body part 310 in contact with the rack bearing part 340, and the manufacturing cost may be saved by removing the separate process for forming a bearing tracking part.

According to an embodiment, the inner circumference surface of the rack roller main body part 310 may further comprise a connecting part 313 connecting the horizontal surface part 311 and the vertical surface part 312.

With reference to FIGS. 6, 7 and 13, the connecting part 313 connecting the horizontal surface part 311 and the vertical surface part 312 may be formed in various shapes such as a gentle curved shape or a shape curved at one side.

At this time, with reference to FIG. 13, the angle θ formed with a horizontal line H and a vertical line V by a tangent line T in contact with the connecting part 313 may be configured to form an acute angle. Accordingly, jamming may be prevented by not comprising a separate bearing tracking part, and operability may be improved by increasing the contact area with the rack bearing part 340 according to the movement during operation.

With reference to FIG. 8, the rack roller part 300 according to an embodiment of the present invention may further comprise a rack bearing seating part 350.

As illustrated in (b) of FIG. 8, the rack bearing seating part 350 is formed in a structure having one or more bearings seated along the outer circumference surface of the end side accommodated in the rack roller main body part 310 of the rack coupling part 330. Accordingly, the one or more bearings may be seated on the rack bearing seating part 350 without contacting each other and may support the operation of the rack roller part 300 while rotating more stably.

FIG. 9 is a cross-sectional view of an upper support roller part according to an embodiment of the present invention. FIG. 10 shows a cross-sectional view of an upper support roller part and a perspective view of a first bearing seating part according to another embodiment of the present invention, respectively.

As illustrated in FIG. 9, the upper support roller part 400 according to an embodiment of the present invention may comprise a first roller frame part 410 and a first roller coupling part 420.

The first roller frame part 410 is formed with a concave part corresponding to the shape of the upper guide part 210 along the circumference direction on the outer circumference surface, and is rotatable with respect to the central axis and slides along the guide rail part 200.

A part of the first roller coupling part 420 is accommodated in the first roller frame part 410 and penetrates the central axis of the first roller frame part 410 and one side of the guide main body part 100, so as to couple the first roller frame part 410 and the guide main body part 100. In addition, the first roller coupling part 420 serves as a rotation axis of the first roller frame part 410.

At this time, the first roller coupling part 420 is coupled having the first roller frame part 410 spaced apart from the guide main body part 100 so that the upper support roller part 400 may be moved horizontally by a predetermined distance.

In other words, as illustrated in FIG. 9, the upper support roller part 400 may absorb the horizontal movement or impact from the sliding basket by spacing the guide main body part 100 apart from the first roller frame part 410 so as to form a predetermined width allowing the upper support roller part 400 to move horizontally.

To this end, preferably, the first roller coupling part 420 is formed so that the cross-sectional area of the part penetrating the first roller frame part 410 is larger than the cross-sectional area of the part penetrating one side of the guide main body part 100.

The upper support roller part 400 according to an embodiment of the present invention is characterized by further comprising a first bearing part 430.

The first bearing part 430 is a bearing seated on the first bearing seating part 440, and one or more first bearing parts 430 are disposed along the outer circumference surface of the first roller coupling part 420 in a space between the inner circumference surface of the first roller frame part 410 and the outer circumference surface of the first roller coupling part 420. At this time, the first bearing part 430 may absorb the horizontal movement or impact of the sliding basket in the bearing itself.

For the same purpose, the inner circumference surfaces of the first bearing part 430 and the first roller frame part 410 according to an embodiment of the present invention are spaced apart so that the upper support roller part 400 may be moved horizontally by a predetermined distance.

With reference to FIG. 10, the upper support roller part 400 according to an embodiment of the present invention may further comprise a first bearing seating part 440.

As illustrated in (b) of FIG. 10, the first bearing seating part 440 is formed in a structure having one or more bearings seated along the outer circumference surface of the end side accommodated in the first roller frame part 410 of the first roller coupling part 420. Accordingly, the one or more bearings may be seated on the first bearing seating part 440 without contacting each other and may support the operation of the upper support roller part 400 while rotating more stably.

Meanwhile, similarly to the rack roller part 300, when a bearing track part having a shape corresponding to the outer circumference surface of the first bearing part 430 is formed on the inner circumference surface of the first roller frame part 410, bearing jamming may occur during operation, thereby deteriorating operability. In addition, a separate process for forming a bearing track part is added to the process of manufacturing the first roller frame part 410, thereby increasing the manufacturing cost.

Accordingly, the inner circumference surface of the first roller frame part 410 according to an embodiment of the present invention is formed to comprise a first horizontal surface part 411 and a first vertical surface part 412. In other words, the jamming during operation may be prevented by removing the bearing track part from the inner circumference surface of the first roller frame part 410 in contact with the first bearing part 430, and the manufacturing cost may be saved by removing the separate process for forming a bearing tracking part.

According to an embodiment, the inner circumference surface of the first roller frame part 410 may further comprise a first connecting part 413 connecting the first horizontal surface part 411 and the first vertical surface part 412. At this time, the angle θ1 formed with a horizontal line H and a vertical line V by a tangent line T1 in contact with the first connecting part 413 may be configured to form an acute angle. Accordingly, jamming may be prevented by not comprising a separate bearing tracking part, and operability may be improved by increasing the contact area with the first bearing part 430 according to the movement during operation.

FIG. 11 is a cross-sectional view of a lower support roller part according to an embodiment of the present invention. FIG. 12 shows a cross-sectional view of a lower support roller part and a perspective view of a second bearing seating part according to another embodiment of the present invention, respectively.

As illustrated in FIG. 11, the lower support roller part 500 according to an embodiment of the present invention may comprise a second roller frame part 510 and a second roller coupling part 520.

The second roller frame part 510 may be formed with a concave part corresponding to the shape of the lower guide part 220 along the circumference direction on the outer circumference surface, and is rotatable with respect to the central axis and slides along the guide rail part 200.

Meanwhile, the second roller frame part 510 may be formed to comprise a concave part of an open-type structure whose outside is open along the axial direction while the outer circumference surface thereof corresponds to the lower guide part 220 along the circumference direction.

A part of the second roller coupling part 520 is accommodated in the second roller frame part 510 and penetrates the central axis of the second roller frame part 510 and one side of the guide main body part 100, so as to couple the second roller frame part 510 and the guide main body part 100. In addition, the second roller coupling part 520 serves as a rotation axis of the second roller frame part 510.

At this time, the second roller coupling part 520 is coupled having the second roller frame part 510 spaced apart from the guide main body part 100 so that the lower support roller part 500 may be moved horizontally by a predetermined distance.

In other words, as illustrated in FIG. 11, the lower support roller part 500 may absorb the horizontal movement or impact from the sliding basket by spacing the guide main body part 100 apart from the second roller frame part 510 so as to form a predetermined width allowing the lower support roller part 500 to move horizontally.

To this end, preferably, the second roller coupling part 520 is formed so that the cross-sectional area of the part penetrating the second roller frame part 510 is larger than the cross-sectional area of the part penetrating one side of the guide main body part 100.

The lower support roller part 500 according to an embodiment of the present invention is characterized by further comprising a second bearing part 530.

The second bearing part 530 is a bearing seated on the second bearing seating part 540, and one or more second bearing parts 530 are disposed along the outer circumference surface of the second roller coupling part 520 in a space between the inner circumference surface of the second roller frame part 510 and the outer circumference surface of the second roller coupling part 520. The second bearing part 530 may absorb the horizontal movement or impact of the sliding basket in the bearing itself.

For the same purpose, the inner circumference surfaces of the second bearing part 530 and the second roller frame part 510 according to an embodiment of the present invention are spaced apart so that the lower support roller part 500 may be moved horizontally by a predetermined distance.

With reference to FIG. 12, the lower support roller part 500 according to an embodiment of the present invention may further comprise a second bearing seating part 540.

As illustrated in (b) of FIG. 12, the second bearing seating part 540 is formed in a structure having one or more bearings seated along the outer circumference surface of the end side accommodated in the second roller frame part 510 of the second roller coupling part 520. Accordingly, the one or more bearings may be seated on the second bearing seating part 540 without contacting each other and may support the operation of the lower support roller part 500 while rotating more stably.

Meanwhile, similarly to the rack roller part 300, when a bearing track part having a shape corresponding to the outer circumference surface of the second bearing part 530 is formed on the inner circumference surface of the second roller frame part 510, bearing jamming may occur during operation, thereby deteriorating operability. In addition, a separate process for forming a bearing track part is added to the process of manufacturing the second roller frame part 510, thereby increasing the manufacturing cost.

Accordingly, the inner circumference surface of the second roller frame part 510 according to an embodiment of the present invention is formed to comprise a second horizontal surface part 511 and a second vertical surface part 512. In other words, the jamming during operation may be prevented by removing the bearing track part from the inner circumference surface of the second roller frame part 510 in contact with the second bearing part 530, and the manufacturing cost may be saved by removing the separate process for forming a bearing tracking part.

According to an embodiment, the inner circumference surface of the second roller frame part 510 may further comprise a second connecting part 513 connecting the second horizontal surface part 511 and the second vertical surface part 512. At this time, the angle $\theta_2$ formed with a horizontal line H and a vertical line V by a tangent line T2 in contact with the second connecting part 513 may be configured to form an acute angle. Accordingly, jamming may be prevented by not comprising a separate bearing tracking part, and operability may be improved by increasing the contact area with the second bearing part 530 according to the movement during operation.

The foregoing description of the present invention has been presented for illustrative purposes, and it is apparent to a person having ordinary skill in the art that the present invention can be easily modified into other detailed forms without changing the technical idea or essential features of the present invention. Therefore, it should be understood that the forgoing embodiments are by way of example only, and are not intended to limit the present disclosure. For example, each component which has been described as a unitary part can be implemented as distributed parts. Likewise, each component which has been described as distributed parts can also be implemented as a combined part.

The scope of the present invention is presented by the accompanying claims, and it should be understood that all changes or modifications derived from the definitions and scopes of the claims and their equivalents fall within the scope of the present invention.

What is claimed is:

1. A rail device for a dishwasher, comprising:

a guide main body part;

an upper support roller part coupled to one side of the guide main body part to be rotatable with respect to a central axis;

a lower support roller part coupled to one side of the guide main body part to be rotatable with respect to a central axis;

a guide rail part extendedly formed along a sliding direction with one side inserted into a space between the upper support roller part and the lower support roller part; and a rack roller part having one side inserted into the guide rail part and the other side coupled to one surface inside the main body of the dishwasher or coupled to a sliding basket, wherein the guide rail part comprises an upper guide part having a shape corresponding to a circumference of the upper support roller part and a lower guide part having a shape corresponding to a circumference of the lower support roller part, and a width L2 of the lower guide part is greater than a width L1 of the upper guide part.

2. The rail device of claim 1, wherein a width ratio (D=width L1 of the upper guide part/width L2 of the lower guide part) of the upper guide part and the lower guide part is greater than or equal to 0.45 and less than 1.0.

3. The rail device of claim 1, wherein the guide rail part further comprises a middle guide part connecting the upper guide part and the lower guide part, and the middle guide part is formed to be spaced apart from the rack roller part inserted into the guide rail part by a predetermined interval so as to form a hollow space A between the guide rail part and the rack roller part.

4. The rail device of claim 3, wherein the upper guide part comprises an upper part, a first upper side surface part bent from one end of the upper part and a second upper side surface part bent from the other end of the upper part, and the lower part of the first upper side surface part is connected to an upper part of the middle guide part.

5. The rail device of claim 3, wherein the lower guide part comprises a lower part, a first lower side surface part bent from one end of the lower part and a second lower side surface part bent from the other end of the lower part, and the lower part of the first lower side surface part is connected to a upper part of the middle guide part.

6. The rail device of claim 1, wherein the rack roller part comprises:

a rack roller main body part inserted into the guide rail part to be rotatable with respect to the central axis;

a rack member part fixedly coupled to one surface inside the main body of the dishwasher; and a rack coupling part penetratingly coupling the center of the rack roller main body part to one side of the rack member part, wherein the rack coupling part couples the rack roller main body part and the rack member part to be spaced apart so that the rack roller part moves horizontally by a predetermined distance.

7. The rail device of claim 6, wherein the rack roller part further comprises a rack bearing part provided with one or more bearings disposed in a space between the inner circumference surface of the rack roller main body part and the outer circumference surface of the rack coupling part.

8. The rail device of claim 7, wherein the rack bearing part is spaced apart from the inner circumference surface of the rack roller main body part so that the rack roller part moves horizontally by a predetermined distance.

9. The rail device of claim 7, wherein the inner circumference surface of the rack roller main body part comprises a horizontal surface part, a vertical surface part and a connecting part connecting the horizontal surface part and the vertical surface part.

10. The rail device of claim 6, wherein the width L2 of the lower guide part is formed to be larger than a width W of a rolling part of the rack roller main body part.

11. The rail device of claim 1, wherein the upper support roller part comprises:

a first roller frame part rotatable with respect to the central axis, whose circumference surface is formed to correspond to the upper guide part; and a first roller coupling part penetratingly coupling the center of the first roller frame part to one side of the guide main body part, wherein the first roller coupling part couples the first roller frame part and the guide main body part to be spaced apart so that the upper support roller part moves horizontally by a predetermined distance.

12. The rail device of claim 11, wherein the upper support roller part further comprises a first bearing part provided with one or more bearings disposed in a space between the inner circumference surface of the first roller frame part and the outer circumference surface of the first roller coupling part.

13. The rail device of claim 12, wherein the first bearing part is spaced apart from the inner circumference surface of the first roller frame part so that the upper support roller part moves horizontally by a predetermined distance.

14. The rail device of claim 1, wherein the lower support roller part comprises:

a second roller frame part rotatable with respect to the central axis, whose circumference surface is formed to correspond to the lower guide part; and a second roller coupling part penetratingly coupling the center of the second roller frame part to one side of the guide main body part, wherein the second roller coupling part couples the second roller frame part and the guide main body part to be spaced apart so that the lower support roller part moves horizontally by a predetermined distance.

15. The rail device of claim 14, wherein the lower support roller part further comprises a second bearing part provided with one or more bearings disposed in a space between the inner circumference surface of the second roller frame part and the outer circumference surface of the second roller coupling part.

16. The rail device of claim 15, wherein the second bearing part is spaced apart from the inner circumference surface of the second roller frame part so that the lower support roller part moves horizontally by a predetermined distance.

17. The rail device of claim 1, wherein the lower guide part comprises a plurality of drainage holes.

18. The rail device of claim 17, wherein the plurality of drainage holes is provided at a lower end of the lower guide part.

* * * * *